United States Patent [19]

Hammett

[11] Patent Number: 4,958,389

[45] Date of Patent: Sep. 25, 1990

[54] PORTABLE/DISPOSABLE SHOWER-BATH

[76] Inventor: Rawlings H. Hammett, P.O. Box 307, Grandview, Mo. 64030

[21] Appl. No.: 313,181

[22] Filed: Feb. 21, 1989

[51] Int. Cl.[5] ..... A61H 33/00; A47K 3/06

[52] U.S. Cl. ..... 4/547; 4/588; 4/596; 4/599; 4/585

[58] Field of Search ..... 4/547, 585, 596, 599, 4/601, 604, 615, 618, 525, 588, 586, 546, 535, 536, 537; 128/365, 366

[56] References Cited

U.S. PATENT DOCUMENTS

| | | | |
|---|---|---|---|
| 736,089 | 8/1903 | Gray | 4/585 |
| 1,879,915 | 9/1932 | Smoot | 4/599 |
| 2,471,302 | 5/1949 | Boward | 4/547 |
| 2,504,646 | 4/1950 | Burrow | 4/585 |
| 2,659,899 | 11/1953 | Willis | 4/599 |
| 3,557,392 | 1/1971 | Schmidt | 4/457 |
| 3,677,263 | 7/1972 | Allen | 128/24.1 |
| 3,749,064 | 7/1973 | Weinstein et al. | 119/158 |
| 4,068,326 | 1/1978 | Deschler | 4/547 |
| 4,312,084 | 1/1982 | Browning | 4/585 |
| 4,566,142 | 1/1986 | Roberts et al. | 4/604 |

FOREIGN PATENT DOCUMENTS 670284 9/1963 Canada .

*Primary Examiner*—Henry J. Recla
*Assistant Examiner*—Glenn T. Barrett
*Attorney, Agent, or Firm*—Norman B. Rainer

[57] ABSTRACT

A device for attachment to a hospital bed to facilitate the showering and/or bathing of bed-ridden patients is comprised of a compliant rectangular waterproof sheet whose perimeter has a multitude of tethers which secure the sheet tightly upon the mattress. A splash cuff is upraised from the upper surface of the sheet to retain water, and a drain port extends through the splash cuff to enable run-off water to be conveniently disposed of.

2 Claims, 3 Drawing Sheets

PORTABLE/DISPOSABLE SHOWER-BATH

BACKGROUND OF THE INVENTION

This invention relates to apparatus facilitating the care of infection-prone and non-ambulatory patients. More particularly this invention relates to a bed cover and water distributing and confining means for bathing a bed-ridden patient.

The care of patients having wounds highly susceptible to infection requires a washing or showering procedure in which the bath area, commonly a shower or hydrotherapy tub, is thoroughly cleaned or sterilized each time so that cross infection of the patients will not occur. Furthermore, the patient must be moved to the bath area which introduces the risk of infection and of the patient falling and becoming further injured.

In hospitals and nursing homes it is generally accepted practice to administer baths to patients by the so called sponge method; namely rubbing the patient's body with a hand held sponge soaked in warm soapy water. This is time-consuming and messy and involves frequent moving of the patient. The rubbing effect may in itself be deleterious in certain disorders. Typically the bed will become somewhat moist and uncomfortable to the patient.

Bed bathing devices disclosed in the prior art do not allow for washing of the patient's head and neck, and do not allow the nurse to physically contact the patient. Therefore, the patient must bathe himself within the confines of such bathing device.

Other bathing devices are large and expensive. Such devices are practical only when used for multiple patients, thereby risking the cross infection of patients. Moreover, bathing devices of this type require that the patient be moved from the bed. In nursing homes, for example, it is generally found that one hour of time is required of a nurse or other health care employee to take a patient from a bed to a bath or shower facility, administer the shower, and safely return the patient to the bed. Such time requirements of the professional staff result in increased costs of health care.

It is therefore an object of the present invention to provide a device for bathing a patient in bed, while protecting the bed from moisture.

It is another object of the present invention to provide a device of the aforesaid nature which is amenable to low cost manufacture and may be discarded upon discharge of the patient from the hospital.

It is yet another object to provide a device of the aforesaid nature which may be easily deployed and compactly stored in close proximity to the patient.

SUMMARY OF THE INVENTION

The above and other beneficial objects and advantages are accomplished in accordance with the present invention by a bed covering device adapted for bathing a patient in a hospital type bed having safety rails and a mattress whose top surface is bounded laterally by left and right sides and head and foot extremities, said device comprised of:

(a) a compliant, rectangular, waterproof sheet having upper and lower surfaces, a perimeter extending beyond the lateral boundaries of a mattress with which the covering device is interactive, and defined by head and foot extremities and left and right sides, (b) a number of grommeted apertures evenly spaced about said perimeter, (c) a splash cuff bonded to said upper surface and extending upright therefrom, said cuff having a perimeter adapted to surround said patient, and accommodating at least one penetrating drain port, (d) at least one drain hose having a proximal extremity adapted to engage said drain port, and a distal extremity which may be located at a convenient disposal site and, (e) multiple securing means having inside and outside extremities, said inside extremities adapted to engage said grommetted apertures, said outside extremities adapted to engage said safety rails.

In a preferred embodiment, the splash cuff may be pneumatically inflatable. The device may have a removable folding shower hood dispoed vertically above the sheet within the perimeter of the splash cuff. The hood may be configured to surround the patient's head and may be equipped with means for spraying water upon the patient.

In another preferred embodiment, the device may have an inflatable type retaining support adapted to maintain the perimeter of the sheet above the level of the patient, thereby serving to accumulate water in a bath type region.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
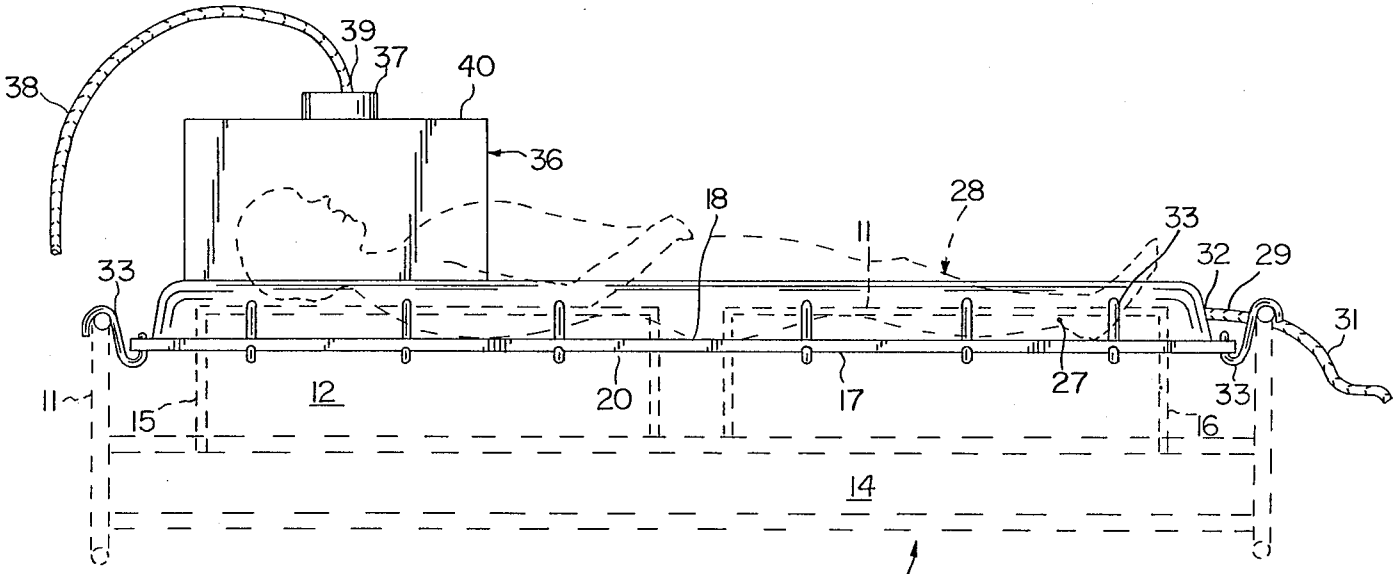
FIG. 1 is a side view of an embodiment of the portable/disposable shower-bath of the present invention shown in operative accociation with a patient lying upon a hospital-type bed.
Figure 2:
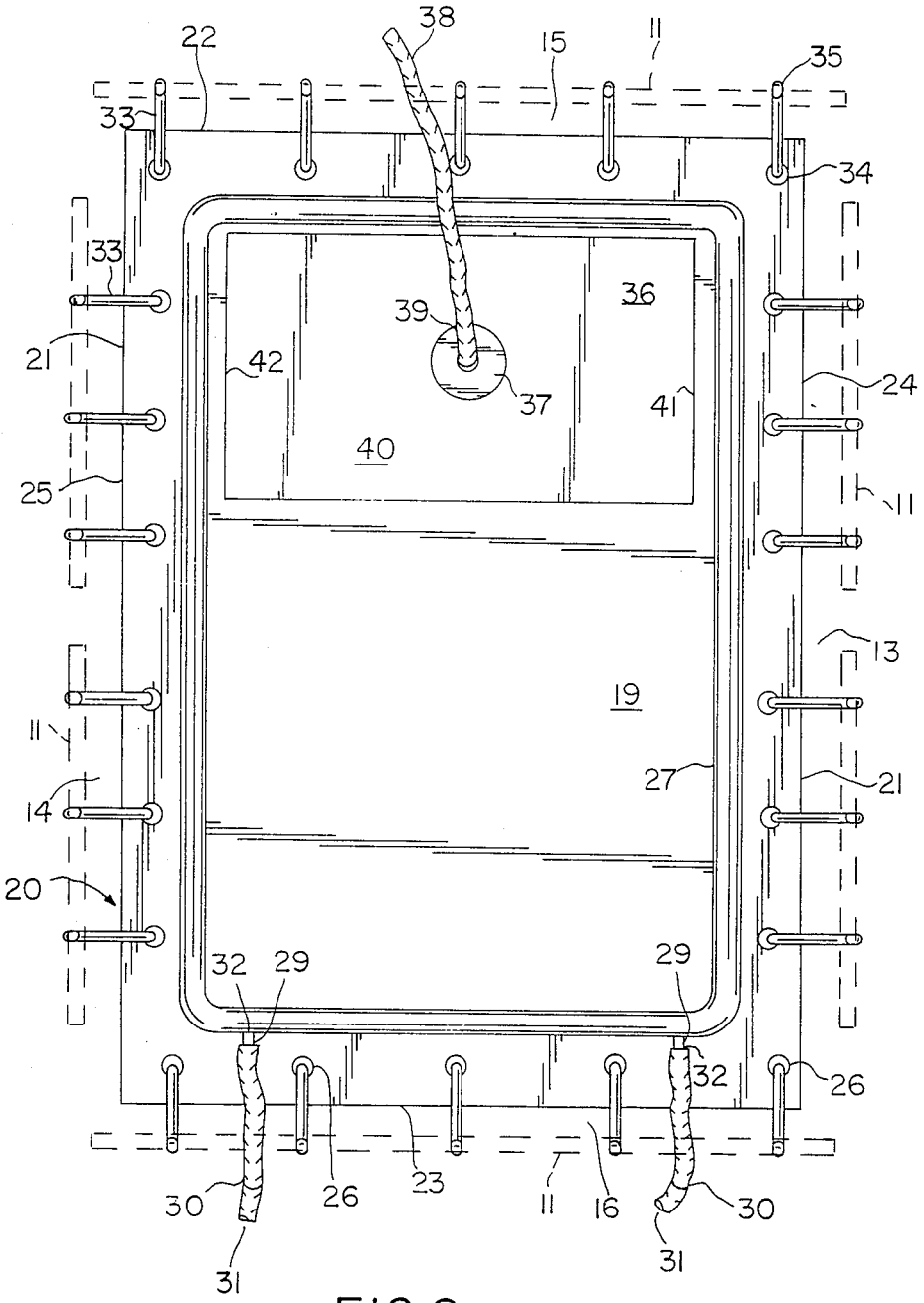
FIG. 2 is a top view of the embodiment of FIG. 1.
Figure 3:
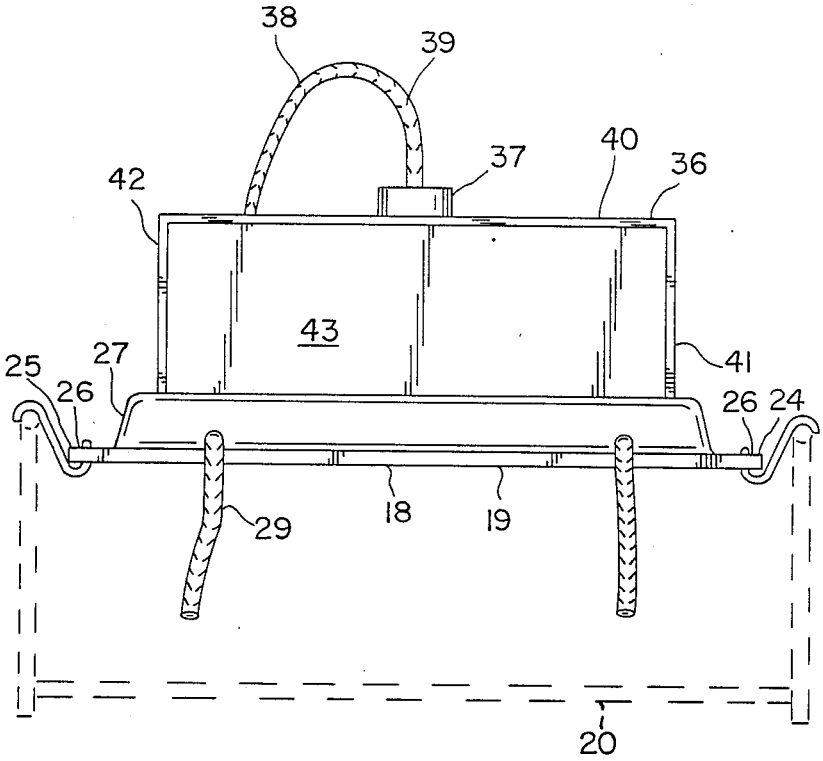
FIG. 3 is an end view of the embodiment of FIG. 1.

Referring to FIGS. 1–3, an embodiment of the bed covering device of the present invention is shown disposed upon hospital type bed 10, having safety rails 11, and mattress 12 having top surface 17, left and right sides 13 and 14, respectively, and head and foot extremities 15 and 16, respectively.

The device is comprised of a compliant, rectangular, waterproof sheet 18 having upper and lower surfaces 19 and 20, respectively, and perimeter 21 extending beyond the lateral boundaries of mattress 12 and defined by head and foot extremities 22 and 23, respectively, and left and right sides 24 and 25, respectively. Grommeted apertures 26 are evenly spaced about said perimeter.

A pneumatically inflatable splash cuff 27 is bonded to upper surface 19 and extends upright therefrom. The cuff has a perimeter adapted to surround patient 28, and accommodates penetrating drain channels 29. Drain hoses 30 have distal extremities 31 and proximal extremities 32 adapted to engage drain channels 29. Securing means in the form of S-hooks 33 have inside and outside extremities 34 and 35, respectively. The inside extremities are adapted to engage grommetted apertures 26, and the outside extremities are adapted to engage safety rails 11. In other embodiments, the securing means may comprise a tether which may have elastomeric characteristics. In such embodiments, at least one extremity of the tether is provided with hook-like means to engage apertures 26 or safety rails 11.

Removable folding shower hood 36 is comprised of top panel 40, left and right side panel 41 and 42, respectively, and rear panel 43. The hood is vertically disposed above sheet 18 within the perimeter of splash cuff 27, and extends across the patient. Means for spraying water upon the patient, in the form of shower head 37, is positioned in top panel 40. Water supply hose 38 has proximal extremity 39 adapted to connect to shower head 37. Alternatively, hose 38 may be disconnected and held free from the shower head in order to rinse the patient's body. The hood may either be constructed of self-supporting rigid panels, or may be constructed of thin film material, and supported upon an interior framework.

In certain embodiments, the hood may be positionable along the length of the patient's body, in which case, rear panel 43 is omitted.

Wash water enters the bathing device through supply hose 38 and is retained within the confines of splash cuff 27. The water exits the bathing device through drain ports 29 and is carried away through drain hoses 30.

While particular examples of the present invention have been shown and described, it is apparent that changes and modifications may be made therein without departing from the invention in its broadest aspects. The aim of the appended claims, therefore, is to cover all such changes modifications as fall within the true spirit and scope of the invention.

Having thus described my invention, what is claimed is:

1. A bed covering device adapted for bathing a patient in a hospital type bed having saftey rails and a mattress whose top surface is bounded laterally by left and right sides and head and foot extremities, said device comprised of:

(a) a compliant rectangular, waterproof sheet having upper and lower surfaces, a perimeter extending beyond the lateral boundaries of a mattress with which the covering device is interactive, and defined by head and foot extremities and left and right sides, (b) a number of grommeted apertures evenly spaced about said perimeter, (c) a splash cuff bonded to said upper surface and extending upright therefrom, said cuff having a perimeter adapted to surround said patient, and accommodating at least one penetrating drain port, (d) at least one drain hose having a proximal extremity adapted to engage said drain port, and a distal extremity positionable at a convenient disposal site, (e) multiple securing means having inside and outside extremities, said inside extremities engaging said grommeted apertures, and said outside extremities being adapted to engage said safety rails, and (f) a removable folding shower hood disposed vertically above said sheet within the perimeter of said splash cuff, said hood being configured to be placed over and surround a patient's head wherein said hood is equipped with means for spraying water upon the head of the patient.

2. The device of claim 1 wherein said splash cuff is pneumatically inflatable.

* * * * *